US005924345A

United States Patent [19]

Hoffman et al.

[11] Patent Number: 5,924,345

[45] **Date of Patent: *Jul. 20, 1999**

[54] METHOD FOR PRECISELY PERFORATING AN OPENING IN FOOTWEAR

[75] Inventors: Howard A. Hoffman, Nashville; Ronald E. Pottorff, Franklin; Lavert F. Sneed, Henderson; William G. Thomas, Hermitage, all of Tenn.

[73] Assignee: Georgia Boot Inc., Franklin, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,618

[22] Filed: Aug. 14, 1996

[51] Int. Cl.[6] ..... B26D 1/03; B26D 7/02

[52] U.S. Cl. ..... 83/13; 83/360; 83/409.1; 83/412; 83/437.3; 83/460; 83/467.1; 83/685; 83/856; 83/936; 83/953

[58] Field of Search ..... 12/146 B, 17 R, 12/50.1; 83/13, 55, 360, 375, 409, 409.1, 412, 422, 425, 431, 435.11, 437.2, 437.3, 452, 459, 684, 688, 936, 953, 856, 460, 685, 658, 437.4, 435.15, 435.17, 465, 467.1; 227/1, 7; 269/902, 252, 268–270

[56] References Cited

U.S. PATENT DOCUMENTS

| | | | |
|---|---|---|---|
| 389,275 | 9/1888 | Woodward | 227/7 |
| 1,161,058 | 11/1915 | Lund | 83/454 X |
| 1,328,144 | 1/1920 | Fenald | 12/17 R |
| 1,500,263 | 7/1924 | Perrault | 12/17 R |
| 1,603,146 | 10/1926 | Perry | 12/17 R |
| 1,678,789 | 7/1928 | Sabin | 83/134 |
| 2,098,235 | 11/1937 | Gilkerson | 12/17 R |
| 2,125,959 | 8/1938 | Seely | 12/17 R |
| 2,291,631 | 8/1942 | Jorgensen | 12/17 R |
| 2,493,859 | 1/1950 | Clarke et al. | 83/454 X |
| 2,648,855 | 8/1953 | Midgley et al. | 12/146 B |
| 3,072,913 | 1/1963 | Morgan et al. | 227/1 |
| 3,249,278 | 5/1966 | MacKenzie et al. | 227/1 |
| 3,400,561 | 9/1968 | Bechtold | 12/17 R |
| 3,434,171 | 3/1969 | Lischer et al. | 12/146 B |
| 5,678,270 | 10/1997 | Mercalli et al. | 12/17 R |

FOREIGN PATENT DOCUMENTS

| | | | |
|---|---|---|---|
| 57017 | 1/1863 | France | 12/17 R |
| 542315 | 4/1931 | Germany | 12/17 R |
| 510468 | 8/1939 | United Kingdom | 12/17 R |

*Primary Examiner*—Rinaldi I. Rada
*Assistant Examiner*—Boyer Ashley
*Attorney, Agent, or Firm*—Malina & Wolson

[57] ABSTRACT

A method for precisely perforating an opening in footwear by positioning the footwear on a foot form with the outsole facing upward, supporting the vamp area of the footwear by a V-shaped support, clamping the rear section of the footwear to stabilize the footwear and moving the footwear upwardly against the die under pressure so that an opening is perforated in the heel area of the footwear. The apparatus includes a shuttle member on which the foot form, the V-shaped support and the clamp are carried. The clamp is activated when the shuttle is moved to contact a limit switch. The footwear is caused to be moved upwardly against the die under pressure upon the operator activating a switch.

4 Claims, 12 Drawing Sheets

METHOD FOR PRECISELY PERFORATING AN OPENING IN FOOTWEAR

BACKGROUND OF THE INVENTION

1. Field of the Invention

The present invention relates generally to a method and apparatus for precisely perforating an opening in the heel area of footwear. The invention is particularly useful in goodyear welt constructed footwear wherein a significant number of nails are present in the heel area and care must be taken to avoid perforating the opening in an area where nails are present.

2. Description of the Prior Art

There is disclosed in pending U.S. patent application Ser. No. 08/562,009, "Improved Cushioned Footwear and Apparatus for Making the Same", which is assigned to the assignee of the present application, a cushioned footwear having an opening in the heel area for insertion of a heel cushioning element. The nail pattern used in such footwear is carefully selected to avoid the presence of nails in the heel area opening and the shank is designed so that it does not interfere with the insertion of the heel cushioning element in the heel area opening. The patent application discloses, in general, the use of a die for making the opening, but does not include a description of the method and apparatus for doing so.

SUMMARY OF THE INVENTION

The present invention concerns a method and apparatus for perforating a precise opening in the heel area of footwear. The method comprises positioning the footwear on a foot opening in the heel area of footwear. The method comprises positioning the footwear on a foot form with the outsole facing upward, supporting the vamp area of the footwear by means of a V-shaped support, clamping the rear section of the footwear to stabilize the footwear, positioning the heel area of the footwear under a die, and causing the footwear to be moved upwardly against the die under pressure to perforate an opening in the heel area of the footwear. The apparatus includes a shuttle member on which the foot form, the V-shaped support and the clamping means are carried. The shuttle member is moveable within a track. The heel clamping means is activated when the shuttle is moved rearwardly to contact a limit switch, after which the shuttle is moved further rearwardly to its home position. Locking means are provided to prevent rearward movement beyond the home position. A switch is activated which causes upward movement of the shuttle and footwear thereon whereby the footwear is moved upwardly under pressure against a die to perforate the opening in the heel area.

Accordingly, it is an object of this invention to provide a method and apparatus for perforating a precise opening in the heel area of footwear.

Other objects and attendant advantages of this invention will be readily appreciated as the same becomes more clearly understood by references to the following detailed description when considered in connection with the accompanying drawings in which like reference numerals designate like parts throughout the figures thereof.

DETAILED DESCRIPTION OF THE PREFERRED EMBODIMENT

Figure 1:
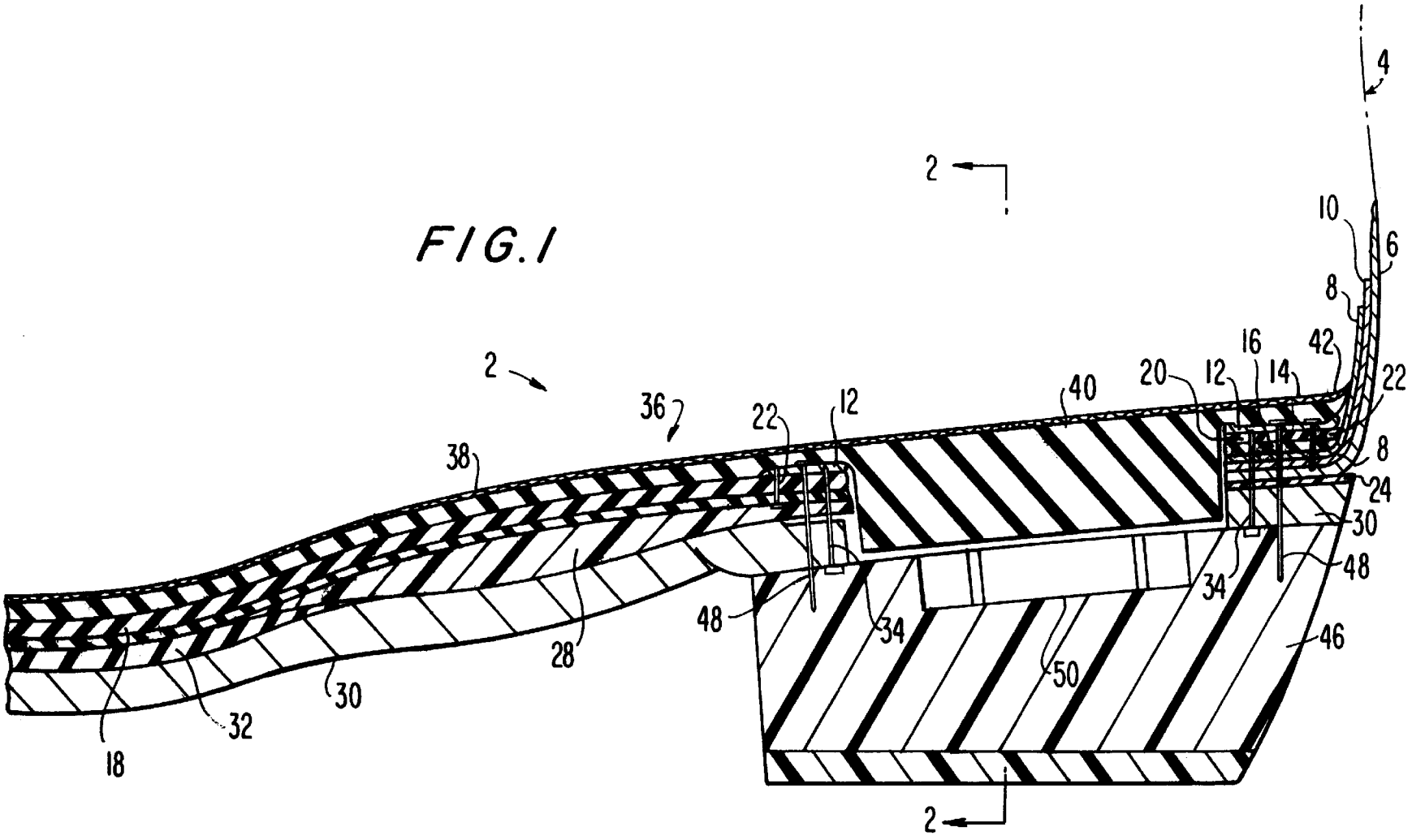
FIG. 1 is a partial side elevational view of the type of footwear with which the method and apparatus of the present invention is particularly useful.
Figure 2:
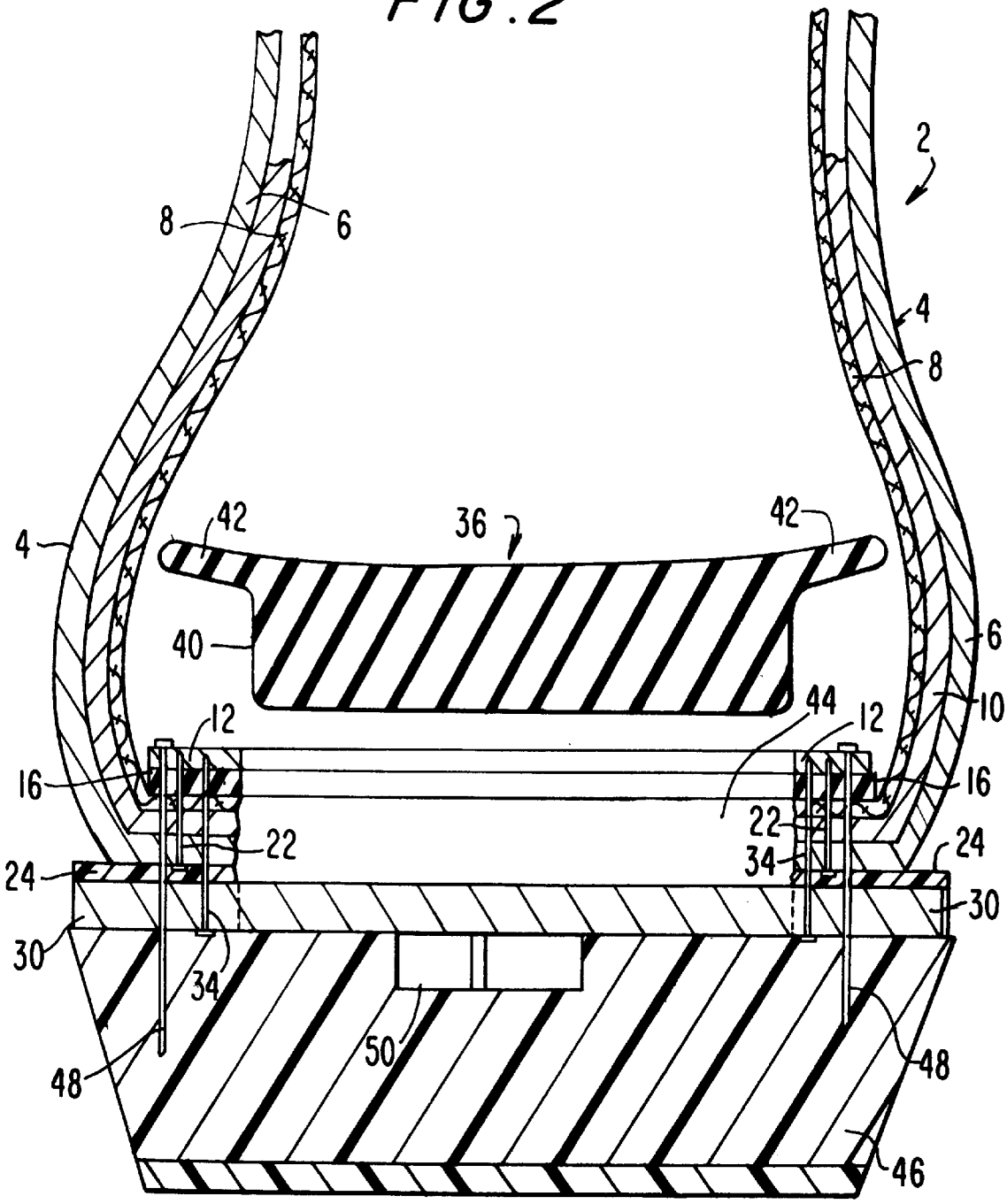
FIG. 2 is a partial rear elevational sectional view of the footwear shown in FIG. 1 taken along line 2—2 of FIG. 1.

The present invention is particularly useful for, but is not limited to, perforating an opening in the heel area of footwear in which there is a significant number of nails in the heel area and the opening must be precisely perforated in order to avoid the nails. An example of such footwear is shown in FIG. 1 and FIG. 2, wherein footwear 2 includes an upper 4, which may be formed of leather 6, a lining 8, and a counter 10 therebetween. The counter is a stiffener of leather, fiber or other material which provides permanent form to the footwear upper around the heel. A tuck 12 is secured to the top of the heel portion 14 of an insole 16 and to the top surface of the rear section of a forward portion 18 of insole 16. Forward portion 18 of insole 16 comprises laminated foam material and a rear portion of insole 16 includes laminated foam material 20. Tuck 12 is a dense, rigid material such as laminated wood, fiberboard or stiff leather. The function of tuck 12 is to anchor heel seat nails 22 which secure the tuck 12, insole 16 and upper 4. The tuck 12 is required because the insole 16 is less dense and rigid than tuck 12 and could not anchor the heel seat nails 22.

The heel area of upper 4 is located between the heel portion 14 of insole 16 and a rand portion 24 of an integral road and shank 26, which may be formed of hard plastic material. Integral rand and shank 26 includes an opening 27 (shown in dotted lines in FIG. 3) for the purpose of relieving the pressure on the die when the opening in the heel area is perforated. A shank portion 28 (see FIGS. 3 and 4) of integral rand and shank 16 extends underneath the rear of the forward portion 18 of insole 16. Outsole 30 extends beneath a bottom filler 32, the shank portion 28 of integral rand and shank 26 and the rand portion 24 of integral rand and shank 26. Gang nails 34 are provided to secure outsole 30, rand portion 24 of integral rand and shank 26, upper 4, insole 16 and tuck 12. The gang nails 34 are nailed from the bottom of outsole 30 and curled into tuck 12 so as to be anchored therein.

A cushioning element 36 of foam material includes a front section 38 and a rear heel plug 40. A peripheral lip portion 42 of cushioning element 36 rests on tuck 12. Rear heel plug 40 of cushioning element 36 extends into an opening 44 formed by aligned openings in tuck 12, insole 16, rand portion 24 of integral rand and shank 26 and outsole 30. The front section 38 of cushioning element 36 rests on insole 16.

Figure 3:
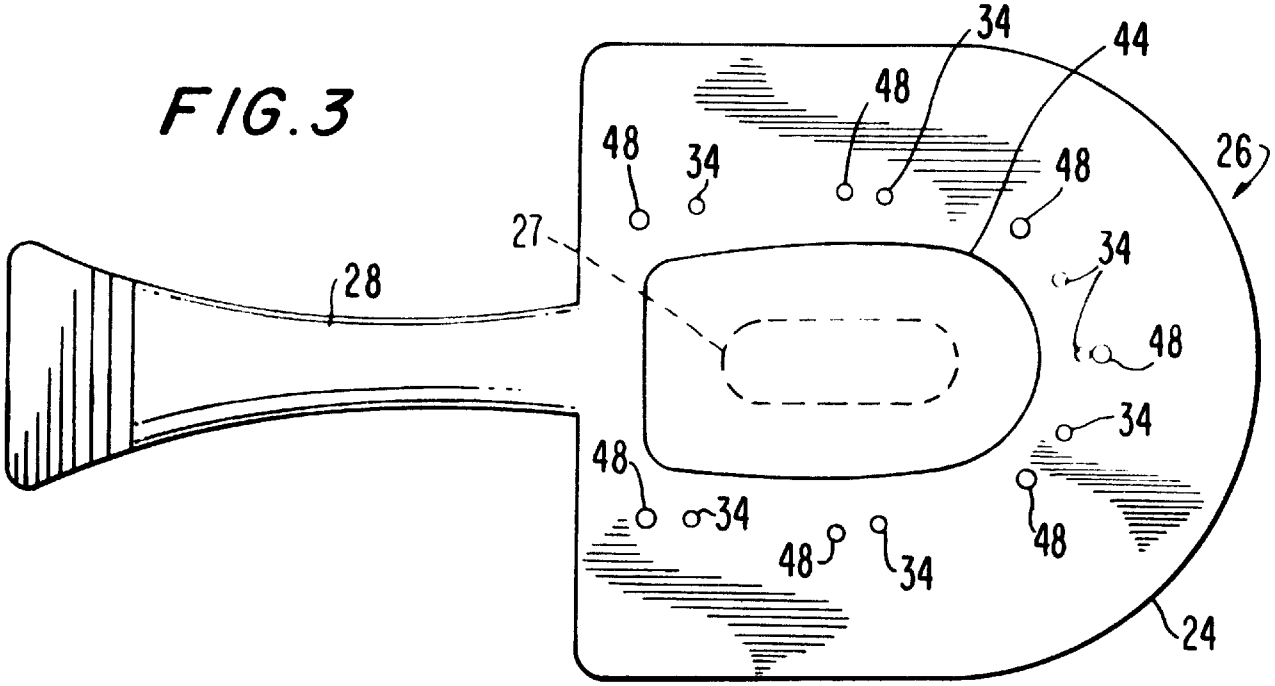
FIG. 3 is a plan view of an integral shank and rand utilized in the footwear shown in FIG. 1.
Figure 4:
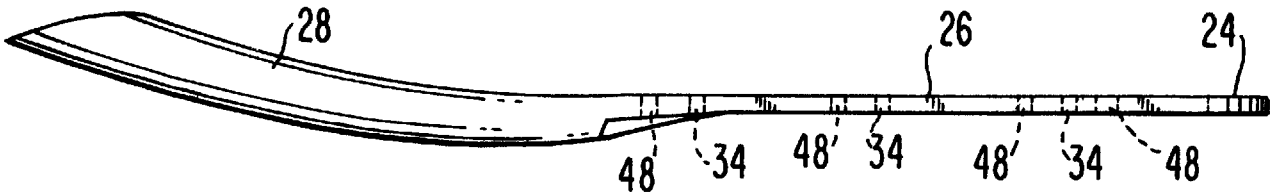
FIG. 4 is a side elevational view of the integral shank and rand utilized in the footwear shown in FIG. 1.
Figure 5:
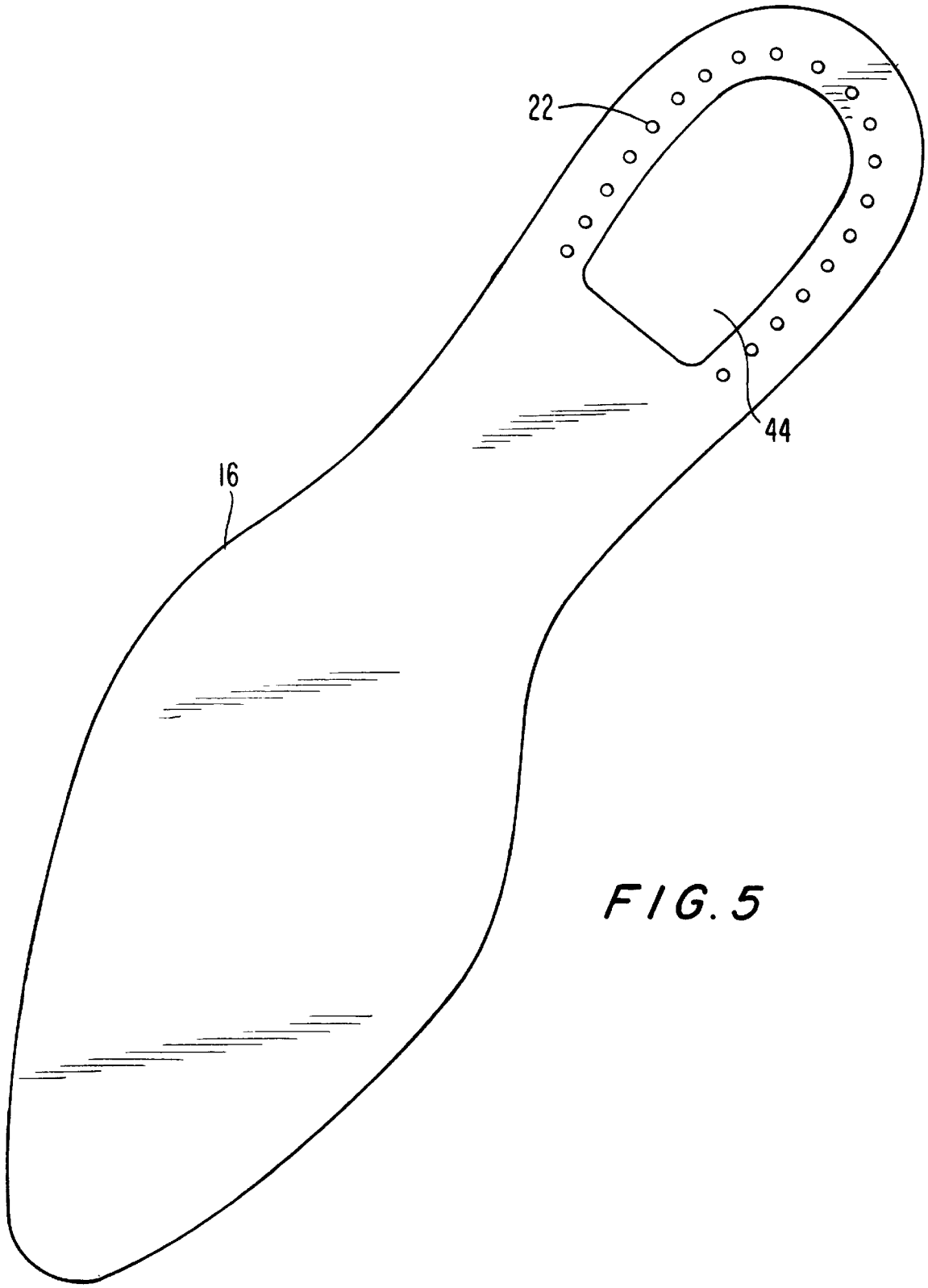
FIG. 5 is a schematic bottom view of the insole of the footwear embodying the present invention which shows the heel seat nails.

A representative pattern of heel seat nails 22 is shown in FIG. 5. Representative patterns of gang nails 34 and heel nails 48 are shown in FIG. 3 and FIG. 4. It is seen that opening 44 must be precisely perforated in order to assure that none of the nails which form the nail patterns of heel seat nails 22 or gang nails 34 extends therein. A heel 46 is nailed to footwear 2 by heel nails 48 which are nailed from the top of tuck 12. Heel 46 includes a cooling chamber 50 which enables cooling of heel 46 during the manufacturing process of the heel.

The apparatus which was selected to be modified for the present invention was a Schoen Model 52C Twin Insole Molding Press sold by International Industrial Products Corporation of Nashville, Tenn. This machine has the capability of generating the pressure required to perforate the heel area of the footwear and of alternatively perforating right and left footwear. The means for perforating the right and left footwear are identical and therefore only one such means will be described.

Figure 6:
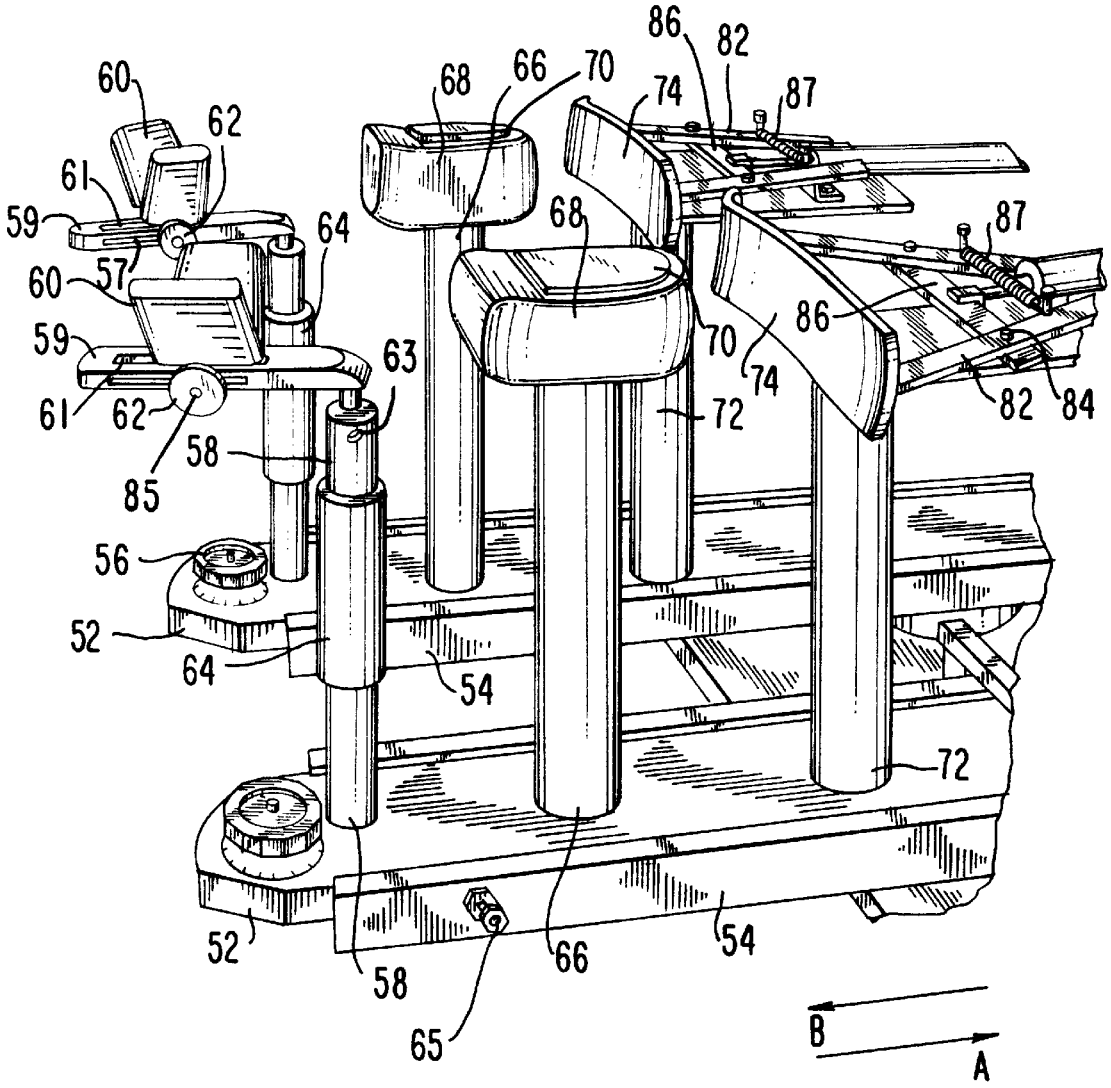
FIG. 6 is a perspective view of the footwear support apparatus of the present invention with the shuttle member in its rest position.
Figure 13:
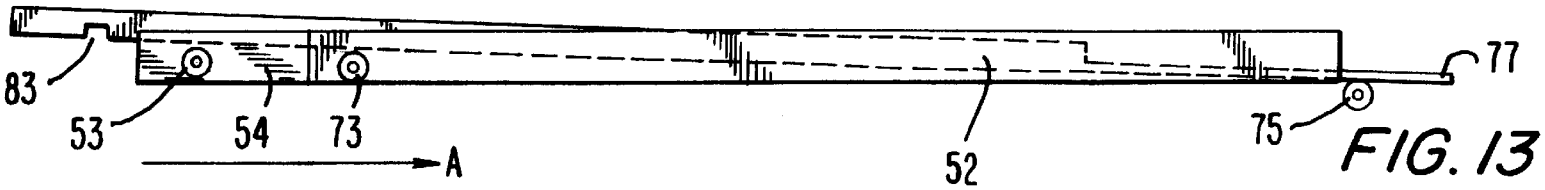
FIG. 13 is a schematic partial side elevational view of the shuttle and track of the present invention and wherein the shuttle is in an intermediate position.
Figure 14:
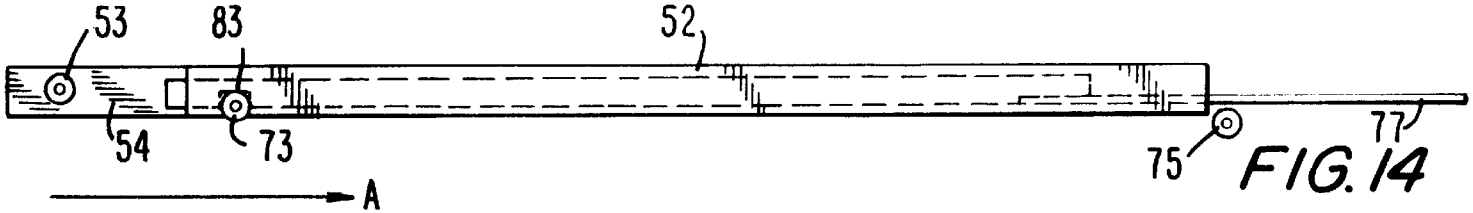
FIG. 14 is a schematic partial side elevational view of the shuttle and track of the present invention and wherein the shuttle is in its home position.
Figure 15:
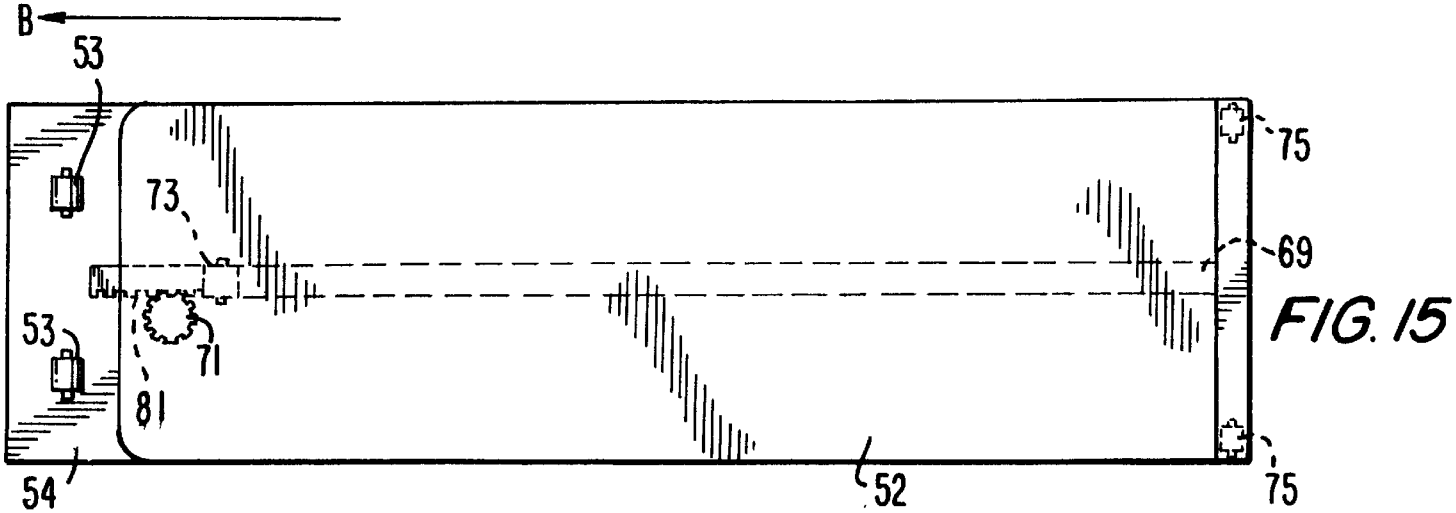
FIG. 15 is a schematic partial plan view of the shuttle and track of the present invention and wherein the shuttle is in its home position.

The working area of the press was modified to include shuttle 52 (see FIG. 6), moveable in a track 54 in the direction shown by the arrows A and B. Track 54 is inclined upwardly towards the rear as shown in FIGS. 13 and 14. Shuttle 52 includes a gear rack 69 which at one end contains toothed bar 81 which is in engagement with pinion gear 71 on track 54 (see FIG. 15). Mounted on track 54 are aligned cam rollers 53, single cam roller 73 and aligned cam rollers 75. Gear rack 69 includes an opening 83 therein, which is engageable by cam roller 73.

A shuttle adjustment means 56 connects with pinion gear 71 on the underside of shuttle 52 which is in engagement with toothed bar 81 on the inside surface of track 54. Turning knob shuttle adjustment means 56 rotates the pinion gear 71 with respect to the toothed bar 81 to move shuttle 52 forwardly and rearwardly in small increments (e.g. 1/16 inch) with respect to track 54. In this manner, a fine alignment between footwear 2 carried on a foot form 68 and a U-shaped cutting die 94 may be achieved. Track 54, including shuttle 52 thereon, is moveable vertically by means of oil actuated hydraulic cylinder 55 (see FIG. 12). Shuttle 52 includes post 58 in which a shaft 51 is rotatably journalled. Platform 59 is fixed to shaft 51 for rotation therewith. Post 58 contains a recessed allen set screw 63 which, when tightened, holds shaft 51 in place. V-shaped vamp support 60 is moveable forwardly and rearwardly in opening 61 of platform 59 by movement of a threaded rod 85 located within side opening 57 of platform 59 and affixed at one end to the base of V-shaped vamp support 60 (not shown) and at the other end to knurled knob 62. Knurled knob 62 which, when tightened against the side of platform 59, secures V-shaped vamp support 60 in position within opening 61 of platform 59.

V-shaped vamp support 60 is also moveable rotationally on platform 59 by means of a threaded rod 65 (see FIG. 9A) located within opening 61 and affixed at its upper end to the base of V-shaped vamp support 60 and protruding below opening 61 about two inches. Two nuts 67 screwed on threaded rod 65 may be tightened against the underside of platform 59 to secure V-shaped vamp support 60 in a desirable angular relationship with respect to platform 59, or the nuts may be left untightened to permit V-shaped vamp support 60 a certain amount of play. A threaded semi-circular cap 53 is affixed to the end of threaded rod 65.

Post 58 includes intermediate collar portion 64 which is gripped by the operator when the operator moves the shuttle 52 in the direction of arrows A and B.

Figure 7:
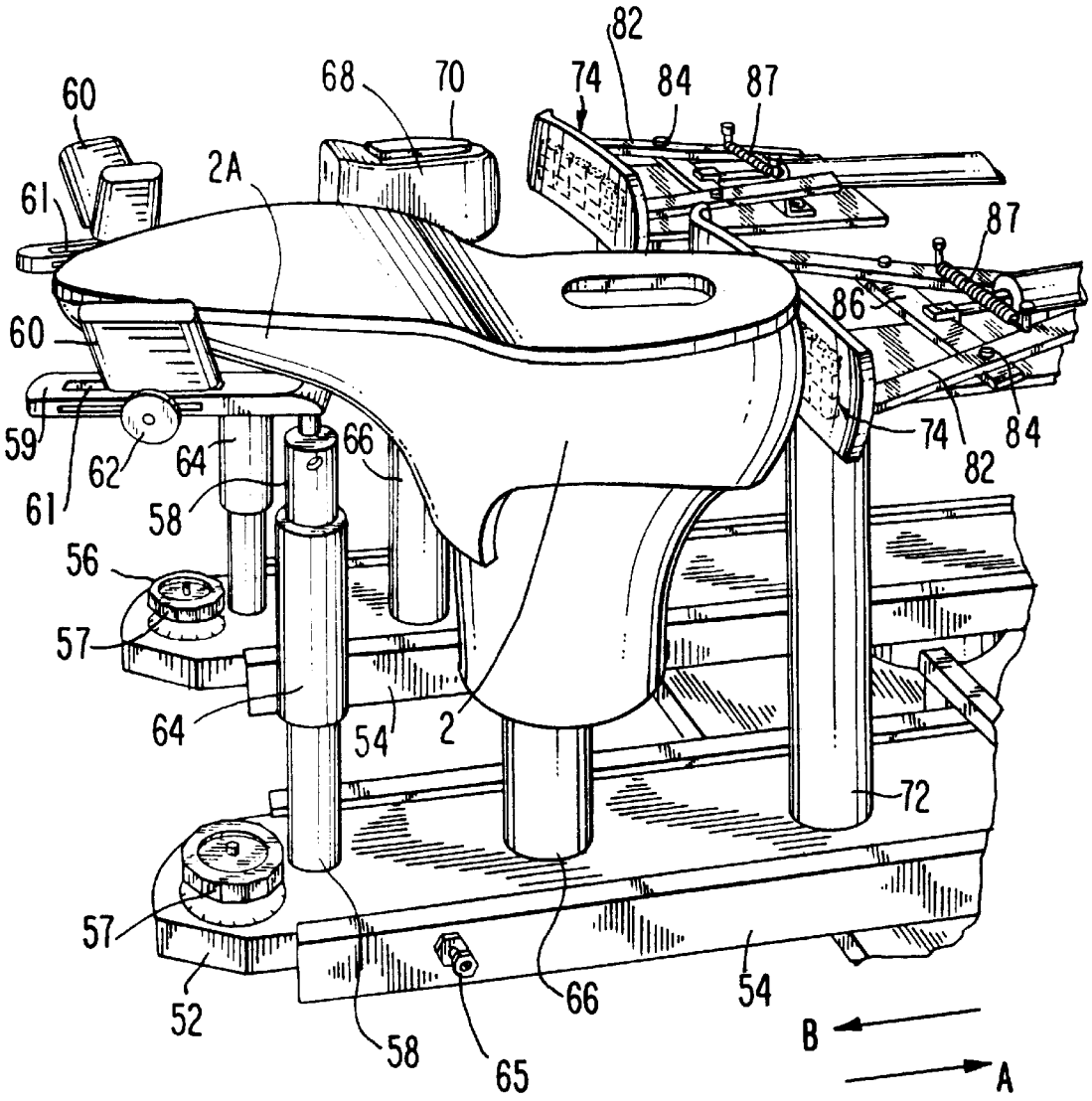
FIG. 7 is a perspective view of the footwear support apparatus of the present invention with the shuttle member in its rest position, and the footwear resting on the vamp support and foot form.

Shuttle 52 also includes post 66 on which foot form 68 is mounted. Foot form 68 is shaped to receive the interior heel area of footwear 2 (see FIG. 7). Foot form 68 includes strike plate 70 formed of hard material, such as a polymer, for example, polypropylene or similar material, which is removable for replacement upon becoming worn. The strike plate 70 must be sufficiently hard to withstand the pressure created by contact with the U-shaped cutting die 94 when the opening in the heel area of footwear 2 is perforated.

Figure 8A:
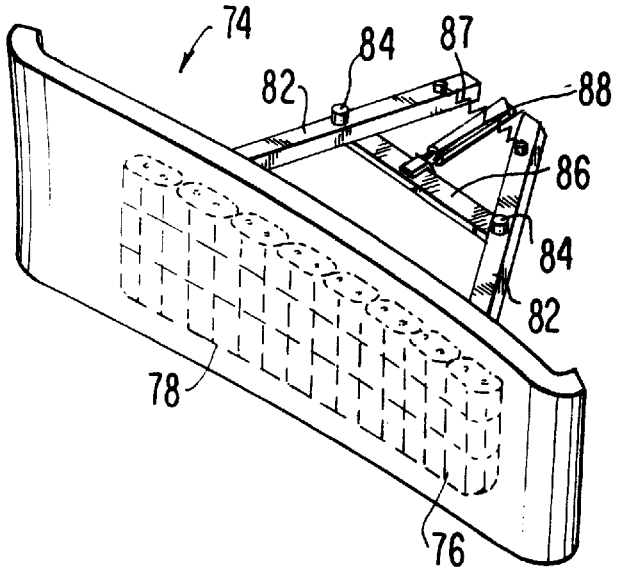
FIG. 8A is a perspective front view illustrating the footwear clamping means in its relaxed position.
Figure 8B:
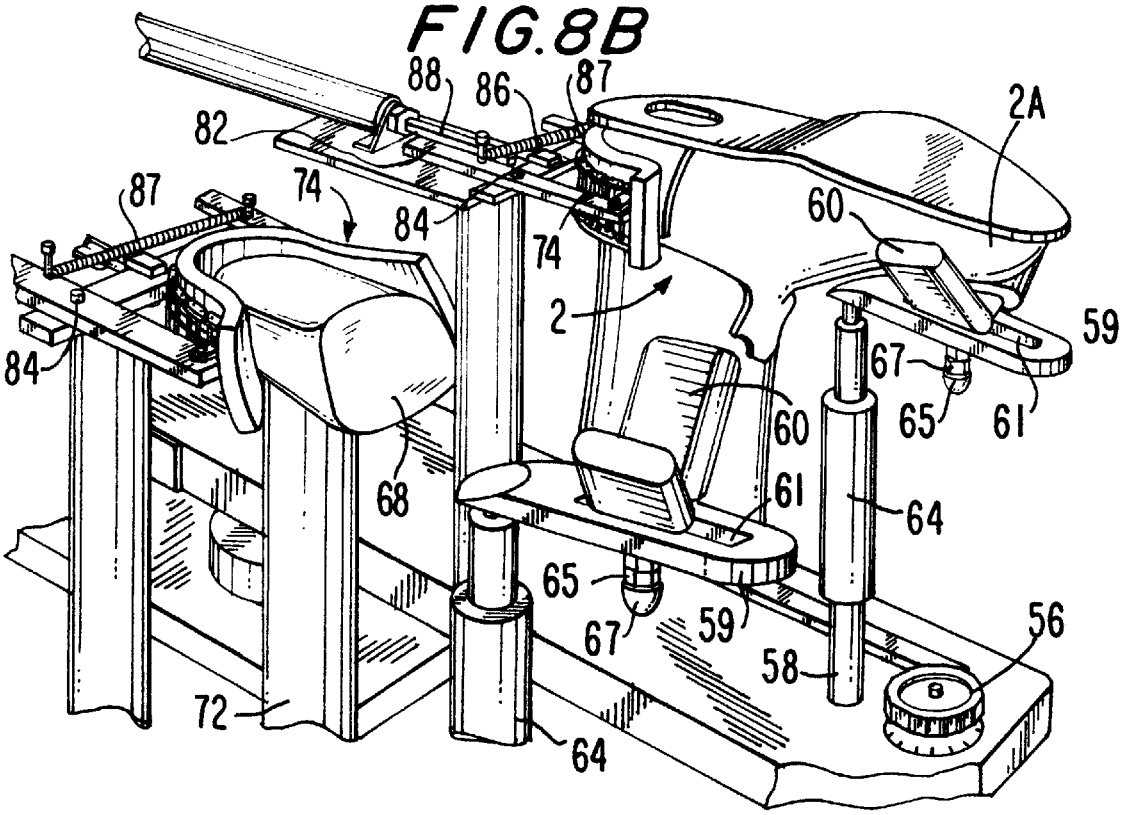
FIG. 8B is a perspective side view illustrating the footwear clamping means in its clamping position.
Figure 8C:
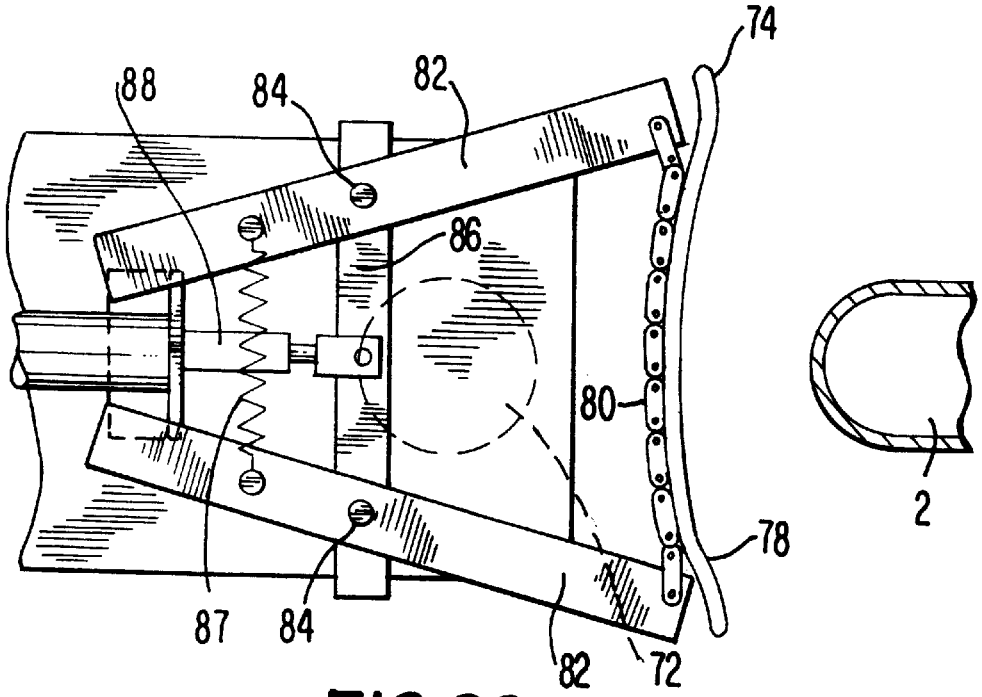
FIG. 8C is a partial plan view of the footwear clamping means in its relaxed position.
Figure 8D:
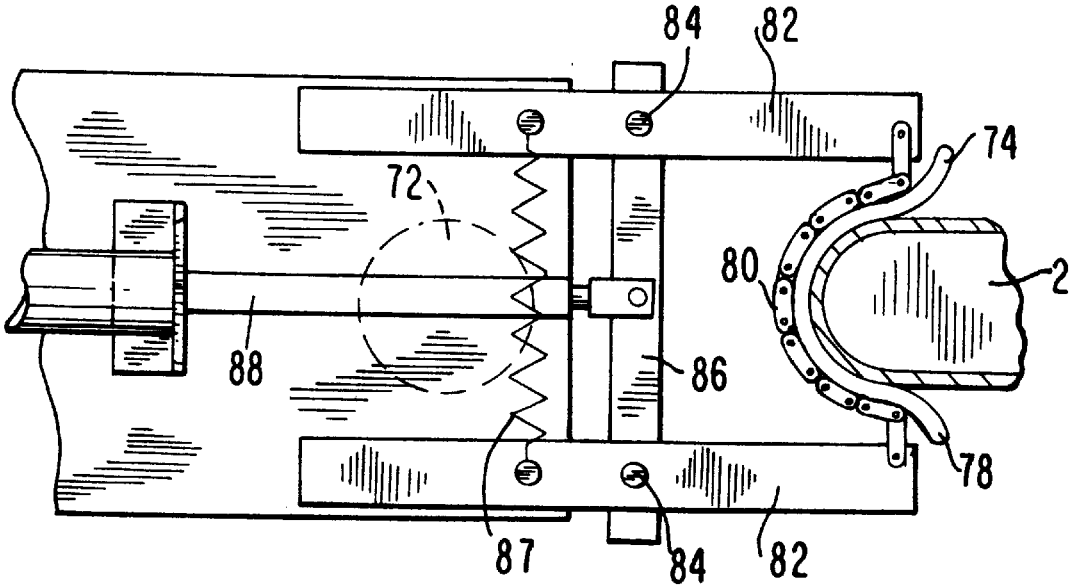
FIG. 8D is a partial plan view of the footwear clamping means in its clamping position.

Shuttle 52 also includes post 72 on which footwear clamping means 74 is mounted. Pivotable footwear clamping means 74 is shown in its relaxed position in FIGS. 8A and 8C, and in its footwear clamping position in FIGS. 8B and 8D. Footwear clamping means 74 includes a flexible pad member 76 of soft felt material having a front footwear clamping surface 78 and a rear surface having a flexible triple row of bicycle chain links 80 attached thereto.

Arms 82 have one end attached to chain links 80 and are pivotable about pins 84 of link 86. A spring 87 connects the other ends of arms to each other. A pneumatic piston 88 is fixed to link 86. When air is injected into pneumatic piston 88 by air supply 91 (see FIG. 10) and piston 88 extends, it causes link 86, connected arms 82 and pad member 76 to move toward footwear 2 mounted on foot form 68. As piston 88 continues to extend, pad member 76 wraps around footwear 2 (see FIG. 8B) to clamp and stabilize the rear portion of footwear 2.

Figure 9A:
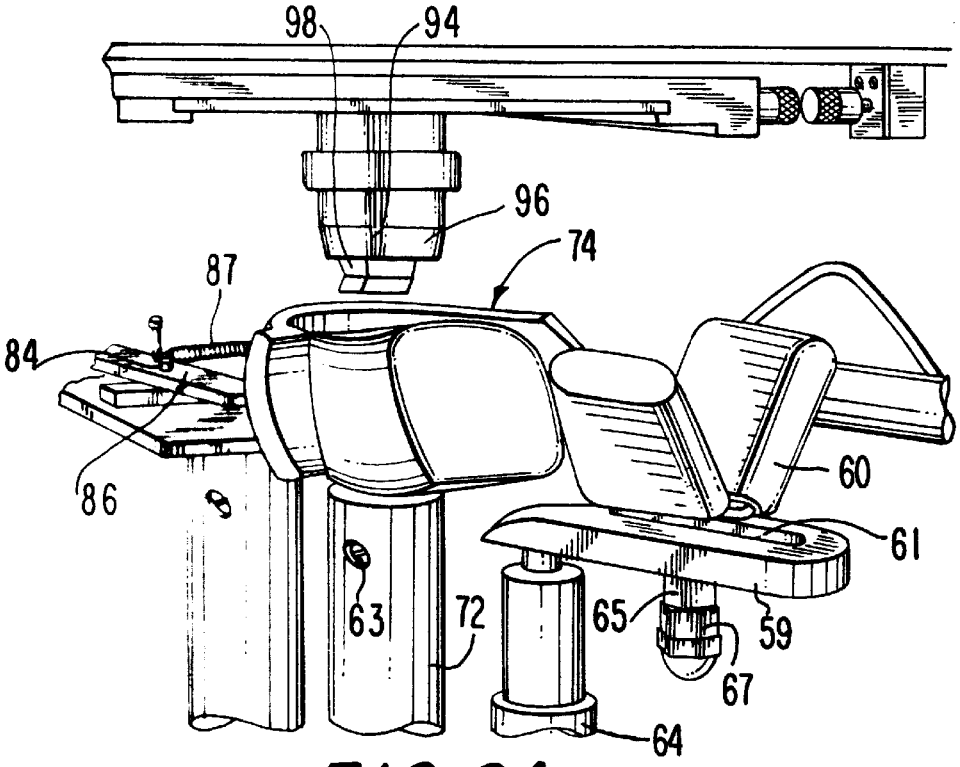
FIG. 9A is a side elevational view of the die utilized in the present invention to perforate the opening in the footwear.
Figure 9B:
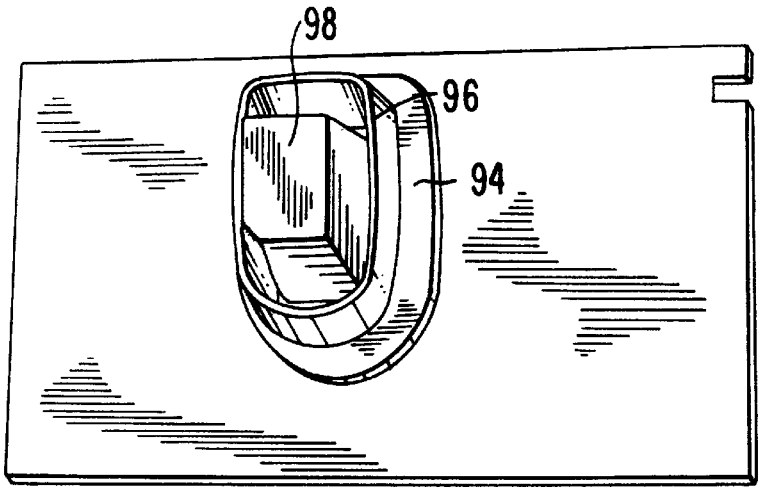
FIG. 9B is a bottom perspective view of the die shown in FIG. 9A.

U-shaped cutting die 94 which perforates the heel area of the footwear 2 is shown in FIGS. 9A and 9B. U-shaped cutting die 94 is stationarily mounted on the frame of the machine and includes a U-shaped cutting blade 96 in the configuration of the opening 44 to be made in the heel area of footwear 2. Located within U-shaped cutting die 94 and extending beyond U-shaped cutting blade 96 is a block 98 which may be formed of compressible hard rubber material.

Figure 10:
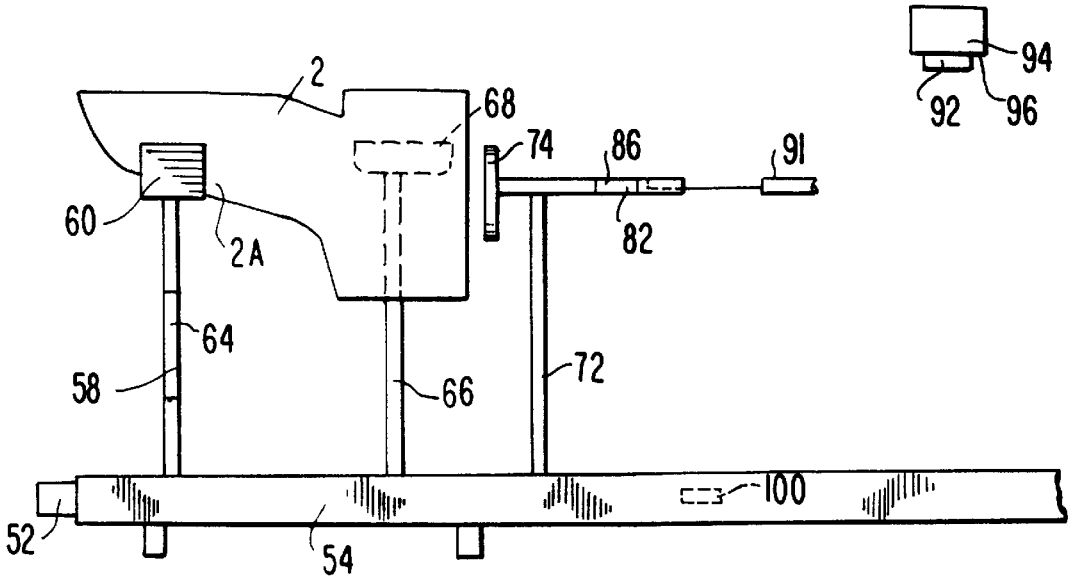
FIG. 10 is a schematic side elevational view of the present invention in its initial rest position.
Figure 11:
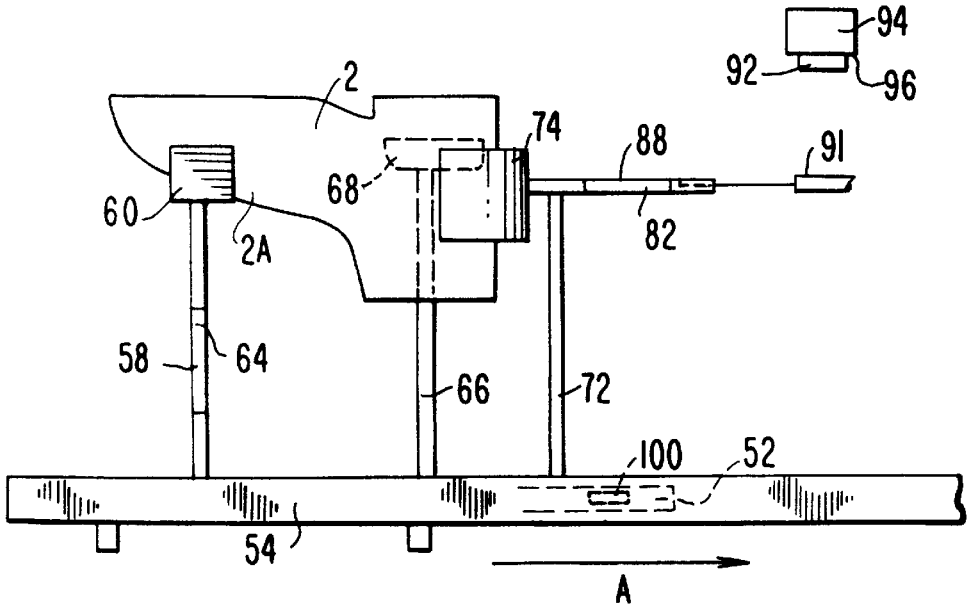
FIG. 11 is a schematic side elevational view of the present invention in its home position.
Figure 12:
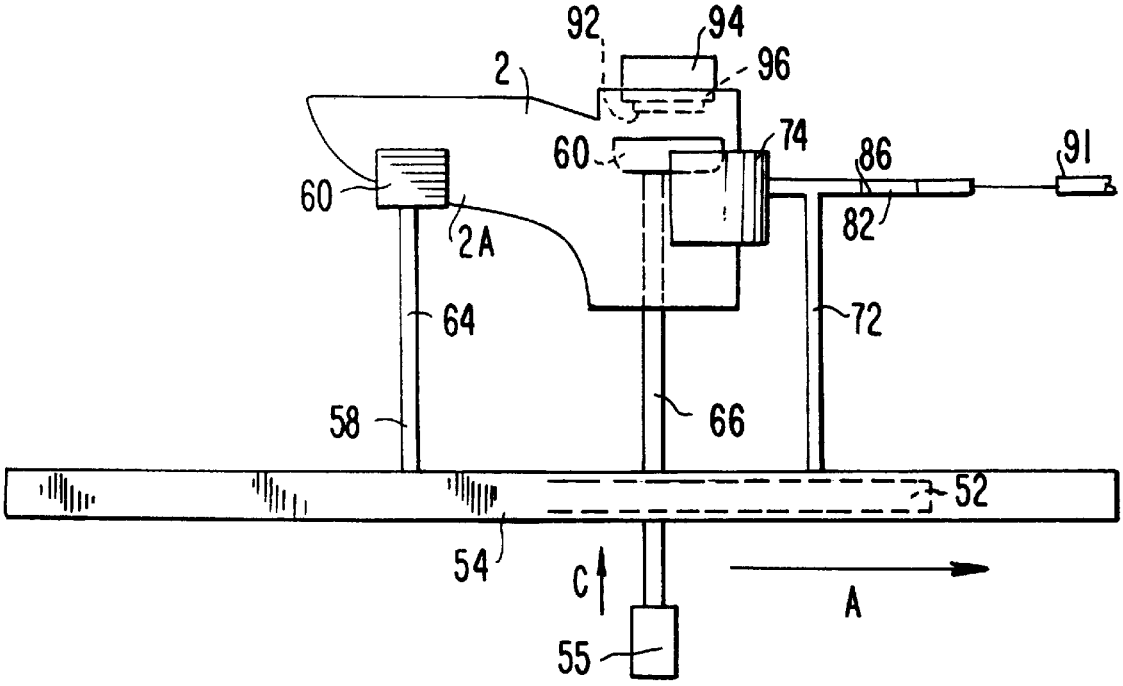
FIG. 12 is a schematic side elevational view of the present invention in its perforating position.

The operation of the present invention will be described with reference to FIGS. 10 to 12. Footwear 2 is placed on foot form 68 with vamp 2A of footwear 2 resting on V-shaped vamp support 60. The V-shaped vamp support 60 may be adjusted rotationally and longitudinally on platform 59 to accommodate the particular configuration of vamp 2A.

In this position, footwear clamping means 74 is in its rest, non-clamping position. The operator grips collar portion 64 of post 58 to move the post 58 on shuttle 52 rearwardly in the direction of arrow A (see FIG. 11). When an arm (not shown) on shuttle 52 contacts a linear activated limit switch 100, located at an interim position on track 54, air is caused to be injected into pneumatic position 88 from air supply 91 causing footwear clamping means 74 to clamp the rear portion of footwear 2. In this position, the footwear is stabilized on foot form 68. The shuttle 52 is then moved further rearward in the direction of arrow A, until it reaches its home position i.e., the position at which footwear 2 will be in alignment with the U-shaped cutting die 94. As shuttle 52 is moved rearwardly in the direction of arrow A (see FIGS. 13 and 14), it contacts a stop pin (not shown) at which point the opening 83 of gear rack 69 is engaged by cam roller 73 to lock the shuttle 52 in position with shuttle 52 being parallel to track 54. An electrical interlock (not shown) is provided to prevent vertical upward movement of track 54 until shuttle 52 is at its home position. With reference to FIG. 13, in which shuttle 52 is in a position prior to that of its home position, and FIG. 14, in which shuttle 52 has been moved to its home position, it will be seen that when shuttle 52 reaches its home position, cam roller 73 is engaged within opening 83 of shuttle 52, and prevents rearward movement of shuttle 52 beyond its home position. At this position, the operator activates a switch (or, for safety purposes, more than one switch may be employed which causes oil actuated hydraulic cylinder 55 to raise shuttle 52 vertically upward in the direction of arrow C, under substantial pressure (see FIG. 12). The heel area of footwear 2 is thus pressed into the U-shaped cutting blade 96, and opening 44 is cut into the heel area by the U-shaped cutting blade 96. As this occurs, block 98 is compressed within U-shaped cutting die 94.

When arm 97 on track 54 (see FIG. 6) contacts an electrical switch located on the frame (not shown) oil actuated hydraulic cylinder 105 is deactivated causing the upward movement of shuttle 52 to terminate and be lowered vertically to the plane it was in prior to activation of oil actuated hydraulic cylinder 105. As shuttle 52 is lowered, the block 98, no longer in its compressed state, pushes out the waste material from the U-shaped cutting die 94. The operator thereafter pulls shuttles 52 forwardly in the direction of arrow B to its initial rest position and removes the perforated footwear. As shuttle 52 is moved forwardly in the direction of arrow B, cam rollers 53 cause shuttle 52 to raise (see FIG. 13) while the rear extensions 77 of shuttle 52 contact rollers 75 for facilitating movement of shuttle 52.

Having thus described the invention, it will be apparent to those skilled in the art that various modifications can be made within the scope of the invention.

We claim:

1. A method for precisely perforating an opening in footwear for receiving a heel plug of a cushioning element comprising the steps of:

a. placing the footwear on a foot form with an outsole of the footwear facing in a position to be perforated;

b. moving the foot form with the footwear thereon to an intermediate position;

c. clamping an exterior rear area of the footwear to the foot form when the foot form and the footwear are moved to the intermediate position to secure it in place;

d. moving the foot form with the footwear thereon to a home position; and e. perforating an opening in the shape of the heel plug of the cushioning element in a heel area of the clamped footwear when the foot and the footwear are in the home position.

2. A method of precisely perforating an opening in footwear as recited in claim 1 and comprising the further step of raising the foot form with the footwear thereon under pressure against a cutting edge of a die to perforate the opening in the heel area of the footwear.

3. A method for precisely perforating an opening in footwear for receiving a heel plug of a cushioning element comprising the steps of:

a. placing the footwear on a foot form with an outsole of the footwear facing in a position to be perforated:

b. placing a vamp area of the footwear on a support;

c. moving the foot form with the footwear thereon to an intermediate position;

d. clamping an exterior rear area of the footwear to the foot form when the foot form and the footwear are moved to the intermediate position to secure it in place;

e. moving the foot form with the footwear thereon to a home position; and f. perforating an opening in the shape of a heel plug of the cushioning element in a heel area of the clamped footwear when the foot form and the footwear are in the home position.

4. A method of precisely perforating an opening in footwear as recited in claim 3 and comprising the further step of raising the foot form with the footwear thereon under pressure against a cutting edge of a die to perforated the opening in a heel area of the footwear.

* * * * *